US009375781B2

(12) United States Patent
Goehlich et al.

(10) Patent No.: US 9,375,781 B2
(45) Date of Patent: Jun. 28, 2016

(54) RIVETING DEVICE AND RIVETING METHOD

(71) Applicant: Airbus Operations GmbH, Hamburg, DE (US)

(72) Inventors: Robert Alexander Goehlich, Hamburg (DE); Holger Frauen, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 110 days.

(21) Appl. No.: 14/252,066

(22) Filed: Apr. 14, 2014

(65) Prior Publication Data

US 2014/0304972 A1 Oct. 16, 2014

(30) Foreign Application Priority Data

Apr. 12, 2013 (DE) ..... 10 2013 206 547

(51) Int. Cl.

| | |
|---|---|
| ***B21J 15/02*** | (2006.01) |
| ***B21J 15/24*** | (2006.01) |
| ***B21J 15/32*** | (2006.01) |
| *B21J 7/30* | (2006.01) |

(52) U.S. Cl.

CPC *B21J 15/24* (2013.01); *B21J 15/02* (2013.01); *B21J 15/32* (2013.01); *B21J 7/30* (2013.01); *Y10T 29/49943* (2015.01); *Y10T 29/49956* (2015.01); *Y10T 29/53478* (2015.01); *Y10T 29/53522* (2015.01)

(58) Field of Classification Search

CPC ..... B21J 15/02; B21J 15/22; B21J 7/30; B21J 15/24; Y10T 29/49943; Y10T 29/53478; Y10T 29/49956; Y10T 29/53522; Y10T 29/49803

See application file for complete search history.

(56) References Cited

U.S. PATENT DOCUMENTS

| | | | | |
|---|---|---|---|---|
| 1,074,396 A | | 9/1913 | West et al. | |
| 3,704,506 A | | 12/1972 | Orr et al. | |
| 4,151,735 A | | 5/1979 | McDermott | |
| 5,379,508 A | * | 1/1995 | Givler | B21J 15/10 29/524.1 |

(Continued)

FOREIGN PATENT DOCUMENTS

| | | |
|---|---|---|
| CN | 101817056 | 9/2010 |
| CN | 201702313 | 1/2011 |

(Continued)

OTHER PUBLICATIONS

German Search Report, Apr. 12, 2013.

(Continued)

*Primary Examiner* — Jermie Cozart

(74) *Attorney, Agent, or Firm* — Greer, Burns & Crain Ltd.

(57) ABSTRACT

A riveting device for the riveting of components in an overlap joint, with an upper tool for driving a rivet into a rivet hole passing through the components, and with a lower tool as a dolly, which has a deforming section for purposes of plastically deforming the end of a rivet shaft driven through the rivet hole, wherein the riveting device has a magazine with a feed device for purposes of feeding a rivet into a shot passage of the upper tool, an actuator for purposes of accelerating the rivet introduced into the shot passage of the upper tool in the direction of the components, and an adjustment system for purposes of aligning the shot channel with the rivet hole. Also disclosed is a method for the riveting of components in an overlap joint.

15 Claims, 3 Drawing Sheets

(56) References Cited

U.S. PATENT DOCUMENTS

| | | | |
|---|---|---|---|
| 5,577,315 | A | 11/1996 | Givier |
| 5,813,110 | A | 9/1998 | Arntson et al. |

FOREIGN PATENT DOCUMENTS

| | | |
|---|---|---|
| CN | 201815622 | 5/2011 |
| CN | 202174209 | 3/2012 |
| DE | 3617191 | 7/1987 |
| DE | 10354680 | 7/2006 |
| DE | 202008014886 | 5/2010 |
| EP | 0545638 | 6/1993 |
| EP | 0963803 | 12/1999 |
| EP | 1518638 | 9/2003 |
| WO | 2004012881 | 2/2004 |

OTHER PUBLICATIONS

Chinese Office Action, Aug. 7, 2015.

* cited by examiner

RIVETING DEVICE AND RIVETING METHOD

CROSS-REFERENCES TO RELATED APPLICATIONS

This application claims the benefit of the German patent application No. 10 2013 206 547.7 filed on Apr. 12, 2013, the entire disclosures of which are incorporated herein by way of reference.

BACKGROUND OF THE INVENTION

The invention relates to a riveting device for the connection of components in an overlap joint and to a riveting method for the connection of components in an overlap joint.

In aircraft construction, for the manufacture of an aircraft fuselage, conventionally individual fuselage shells are riveted together in a longitudinal joint, and individual fuselage segments are riveted together in a transversal joint. In this arrangement the fuselage shells are aligned relative to each other in an overlap joint and are provided with a multitude of rivet holes. The fuselage segments are oriented relative to each other in the butt joint and are then provided with straps that bridge the butt joint from the interior, which straps are then riveted to the fuselage segments in an overlap joint.

Known riveting devices have a pneumatic riveting hammer for hammering solid rivets into the rivet holes and a dolly for plastically deforming the ends of rivet shafts driven through the rivet holes. Furthermore, locking ring systems are known in which a locking ring is placed onto a locking ring bolt and when a desired locking force has been attained the bolt end of a locking ring is sheared off.

Moreover, electromagnetic riveting devices and methods are known in which a rivet is positioned in a rivet hole and is then plastically deformed on both ends by means of a hammer element that is electromagnetically accelerated. Such a riveting device and such a riveting method are, for example, shown in WO2004012881A1. The hammer elements arranged on both ends of the rivet act simultaneously on the rivet, wherein for coordinating the hammer elements their positions are optically monitored by means of a laser diode system. From U.S. Pat. No. 5,813,110 it is known to let the hammer elements impact the rivet in a time-delayed manner. Comparative riveting devices and riveting methods are known from U.S. Pat. No. 4,151,735, U.S. Pat. No. 1,074,396, EP545638A1, U.S. Pat. No. 3,704,506 and from EP0963803B2.

U.S. Pat. No. 5,577,315 shows an electromagnetic riveting device and a riveting method in which a rivet is fed to a rivet hole by means of compressed air.

From DE10354680B4 an electromagnetic riveting-punching device and a rivet placement device are known in which a tubular rivet is placed on an overlap joint of two components, and by means of an electromagnetic hammer element is at least in some sections driven through the components. In order to prevent deformation of the components in an overlap joint, a dolly is arranged on a component side facing away from the hammer element.

SUMMARY OF THE INVENTION

It is the object of the invention to create an alternative riveting device for the connection of components in an overlap joint, and an alternative riveting method for the connection of components in an overlap joint.

A riveting device according to the invention for the connection of components in an overlap joint has an upper tool for driving a rivet into a rivet hole passing through the components, and a lower tool as a dolly, which lower tool has a deforming section for the purpose of plastically deforming the end of a rivet shaft driven through the rivet hole. According to the invention, the riveting device has a magazine with a feed device for purposes of feeding a rivet into a shot passage of the upper tool, an actuator for purposes of accelerating the rivet introduced into the shot passage in the direction of the components, and an adjustment system for purposes of aligning the shot passage with the rivet hole.

Because the riveting device has a magazine with a feed device in combination with acceleration of the rivet, there is no need for time-consuming positioning of the rivet in the rivet hole. The rivet is shot into the rivet hole and is plastically deformed when it impacts the dolly. In this arrangement the adjustment system ensures precisely targeted alignment of the rivet relative to the rivet hole. For example, if the riveting device is robot-controlled, setting the rivets can take place in a fully-automated manner.

In one exemplary embodiment the actuator generates an electromagnetic acceleration force acting on the rivet. In this manner reproducibly high and precisely definable acceleration forces can be achieved so that desired plastic deformation of the rivet is ensured. Moreover, such an actuator requires only a source of electrical energy. There is no need to provide pneumatic or hydraulic sources of energy. Furthermore, such an actuator is robust and requires little maintenance.

As an alternative or in addition in the shot passage an electromagnetically movable hammer element can be arranged which acts on the rivet when the actuator is supplied with current. Depending on the material of the hammer element, in this manner the acceleration force acting on the rivet can be significantly increased. Preferably, the hammer element comprises a material or a material alloy with a high iron content. However, magnetizability of the rivet with the use of the hammer element is not mandatory.

At least the acceleration force can be further increased if the actuator has at least two coils that communicate with each other, of which one coil is arranged in the lower tool and the other coil is arranged in the upper tool. As a result of the at least one coil in the upper tool the rivet is quasi pushed through the rivet hole, and as a result of the at least one coil in the lower tool the rivet is pulled through the rivet hole so that the rivet is accelerated over a maximum length.

Preferably, the adjustment system comprises at least one electromagnetic radiation source for purposes of optically aligning the riveting device. The radiation source is, for example, a laser diode by means of which the shot passage can be positioned so as to be aligned with the rivet hole and/or with the lower tool.

The lower tool can comprise a multitude of deforming sections for covering a rivet hole field and thus for covering a multitude of rivet holes. In this manner the effort of positioning the lower tool is kept to a minimum because said lower tool during one-off positioning is associated with a multitude of rivet holes. In order to safeguard the lower tool position said lower tool can, for example, comprise a suction device for suction adhesion to the components.

Preferably, the magazine has a sorting device for providing different types of rivets. Consequently the riveting device is not limited to one type of rivets, but instead it is possible to select from among several types of rivets so that during riveting a rivet can be placed that is optimal in terms of the particular component load.

For purposes of noise reduction the upper tool and/or the lower tool can, at least in some sections, comprise a housing made of a sound-absorbent material. In this manner at least some of the noise arising during riveting can be dampened in the upper tool and/or in the lower tool so that less noise is emitted from the riveting device to the environment.

As an alternative or in addition to the sound-absorbent material, the upper tool and/or the lower tool can be associated with at least one noise cancelling device for at least partial superposition of a riveting noise by an anti-noise. In particular in those cases where exclusively the noise cancelling device is used for noise reduction, the housings of the upper tool and of the lower tool can be constructed in a more lightweight design. In order to be able to precisely determine the timing and intensity of the anti-noise, in the case in which the noise cancelling device is associated with the upper tool the noise cancelling device can communicate with the actuator and with the lower tool in order to calculate the point in time in which the rivet will impact the deforming section. If the noise cancelling device is associated with the lower tool, the noise cancelling device can communicate with the upper tool and in particular with the actuator in order to calculate the point in time when the rivet is or has been accelerated. Of course, the noise cancelling device can also operate autarchically. Furthermore, both the upper tool and the lower tool can each be associated with a noise cancelling device, which noise cancelling devices communicate with each other or operate autarchically.

In a riveting method according to the invention for the connection of components in an overlap joint with a riveting device by means of which a rivet is driven into a rivet hole passing through the components, first the riveting device is positioned relative to the rivet hole, wherein a lower tool of the riveting device is arranged as a dolly on one face of the component, and an upper tool of the riveting device for driving a rivet into the rivet hole is arranged on the opposite face of the component, and in this manner a shot passage in the upper tool is oriented so as to be aligned with the rivet hole. Subsequently a rivet is introduced into the shot passage. Thereafter, the rivet is accelerated in the direction of the components, wherein during driving the rivet in, an end of a rivet shaft driven through the rivet hole is plastically deformed when it impacts a deforming section of the lower tool.

The riveting method makes it possible to fully automatically place rivets. Consequently, the time taken up for joining the components is shortened and the riveting quality is improved when compared to known riveting methods.

Preferably, the rivet is electromagnetically accelerated. An acceleration force generated in this manner can be precisely set and is reproducible to a high degree. In order to reduce the time taken for riveting, the rivet can be driven in and deformed in one shot.

At least the acceleration force can be increased if the rivet is accelerated both on the side of the upper tool and on the side of the lower tool. As a result of this the rivet is quasi pushed through the rivet hole and at the same time is pulled through said rivet hole.

In an alternative exemplary embodiment an electromagnetically accelerated hammer element acts on the rivet. Consequently, the acceleration force can be increased significantly. In particular, an effective rivet connection can take place irrespective of any magnetizability of the rivet. In this arrangement, driving in and deforming the rivet can take place in one shot or in a pulse-like manner by moving the hammer element forward and backward.

In one exemplary embodiment the lower tool is associated with a rivet hole field. As a result of this the lower tool covers a multitude of rivet holes, and consequently after placement of a rivet it is only the upper tool that needs to be positioned anew. Positioning the lower tool on the side of the component can, for example, take place by means of tacking rivets or by means of a vacuum. In this arrangement the lower tool can comprise suction cups that can be brought to rest against the side of the component and that can be removed. After the rivets have been placed, the suction cups are aerated and the lower tool can be associated with a new rivet hole field. Of course, as is the case in an alternative exemplary embodiment, the lower tool can also in each case be associated with only one rivet hole, wherein said lower tool then needs to be positioned anew, so as to correspond to the upper tool, after the respective rivet has been placed. In order to prevent incorrect positioning of the lower tool and of the upper tool both relative to each other and relative to the rivet hole, it is advantageous if in this arrangement the upper tool and the lower tool communicate with each other.

For purposes of noise reduction at least partial overlay of a riveting noise with an anti-noise can take place. In this process, because of electromagnetic activation, the riveting noise is precisely predictable, when compared to known pneumatic activation with a riveting hammer, and consequently the anti-noise can be generated precisely in terms of its timing and intensity.

BRIEF DESCRIPTION OF THE DRAWINGS

Below, preferred exemplary embodiments of the invention are explained in more detail with reference to diagrammatic drawings. The following are shown.

DETAILED DESCRIPTION OF THE PREFERRED EMBODIMENTS

Figure 1:
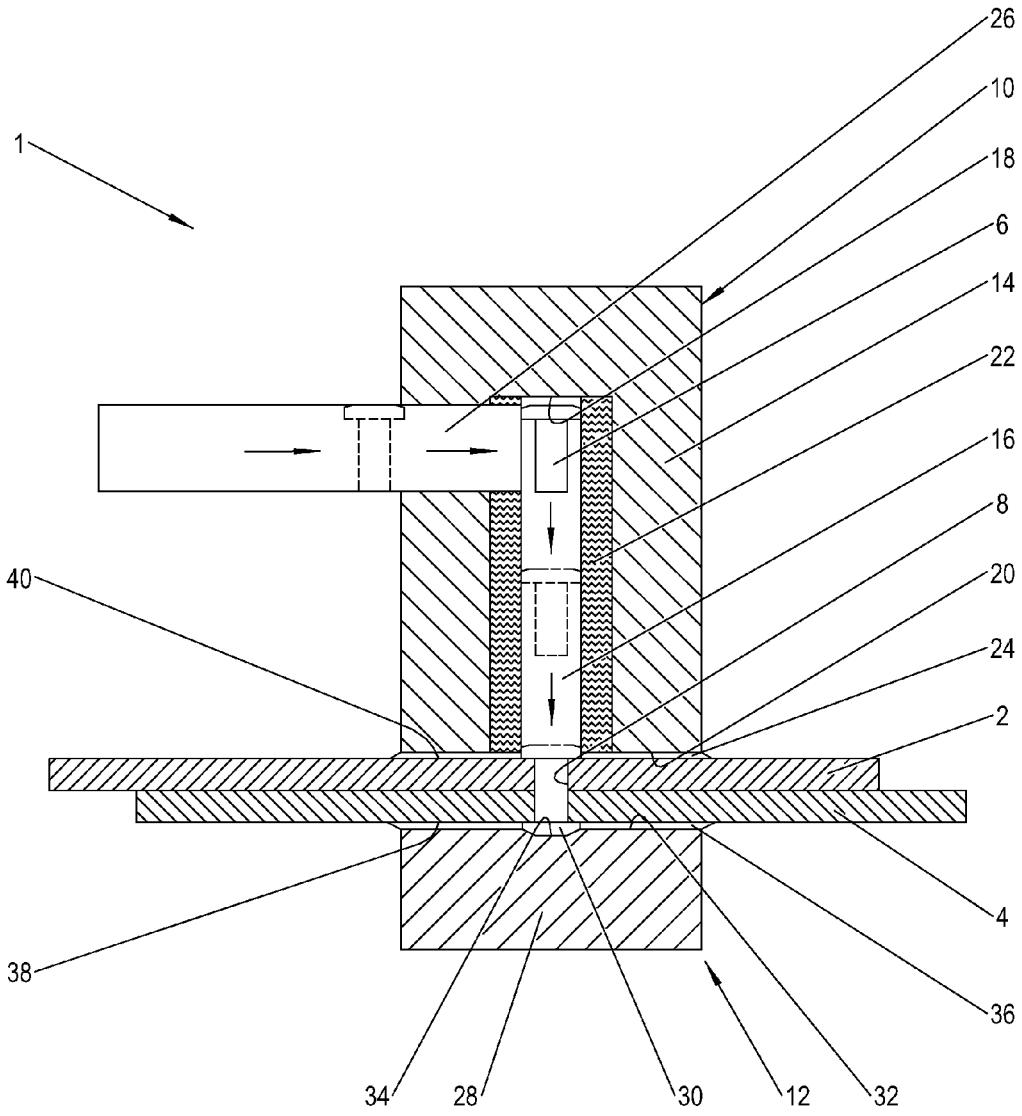
FIG. 1 is a section view of positioning a first exemplary embodiment of a riveting device according to the invention on two components in the overlap joint.

FIG. 1 shows a connection, and in particular a riveted connection, of two components 2, 4 in an overlap joint by means of a first exemplary embodiment of a riveting device 1 according to the invention.

The components 2, 4 are, for example, two fuselage shells of an aircraft fuselage that are joined in the longitudinal direction. For the placement of rivets 6 in an overlap joint, said components 2, 4 comprise a multitude of rivet holes 6. The rivets 6 are preferably solid rivets with a mushroom head or solid rivets of a countersunk-head design. Depending on the components 2, 4 to be joined they comprise a light metal, for example aluminum, or a light metal alloy, or a material with a high iron content. In the connection of aircraft shells, carrier rockets, space shuttle fuselage shells or space station modules, said components 2, 4 preferably comprise aluminum or an aluminum alloy. In contrast to this, for example in the connection of ship hull plates or wind turbine mast plates, the rivets 6 preferably comprise steel or a material with a high iron content. The hammer-operated riveting device described in FIG. 2 also makes it possible to use non-metal rivets.

The riveting device 1 has an upper tool 10 for driving the rivet 6 into the rivet holes 8 and a lower tool 12 that acts as a dolly for the upper tool 10.

The upper tool 10 has a housing 14, which preferably at least in some sections comprises a sound-absorbent material for purposes of reducing riveting noise. A hole-like shot passage 16 has been made in the housing 14. The shot passage 16 has a ground 18 and orthogonally passes through an abutting surface 20 of the housing 14.

For purposes of electromagnetically accelerating the rivet 6 incorporated in the shot passage 16 the riveting device 1 comprises an actuator that comprises at least one coil 22 that encompasses the shot passage 14 along its entire length. The coil 22 interacts with at least one capacitor (not shown) and with control and regulating electronics (not shown).

In order prevent damage to the surface of the component 2 when the upper tool 10 is put in place, on the abutting surface 20 an annular surface protection device 24 is arranged that encompasses the shot passage 16 leading from the abutting surface 20.

In addition, the upper tool 10 is associated with a feed device 26 of the riveting device 1 for the automated supply of rivets 6 to the shot passage 16. The feed device 26 extends from a magazine (not shown) of the riveting device 1 and radially leads to the region of the ground 18 in the shot passage 16 so that an acceleration path of the rivet 6 extends over the entire length of the shot passage 16. Feeding the respective rivet 6 preferably takes place by means of compressed air; however, it can, for example, also take place by means of a mechanical slide or in an electromagnetic manner. Preferably, the magazine comprises a sorting device so that the shot passage 16 can be fed with a multitude of different rivets 6.

The lower tool 12 has a housing 28 which also at least in some sections comprises a sound-absorbent material in order to reduce riveting noise. For purposes of deforming an end of a rivet shaft 30 that is driven through the rivet hole 8, the lower tool 12 in the region of a supporting surface 32 has at least one deforming section 34. In order to prevent damage to the surface of the component 4 when the lower tool 12 is put in place, an annular surface protection device 36 is arranged on the supporting surface 32, which surface protection device 36 encompasses the deforming section 34.

Figure 3:
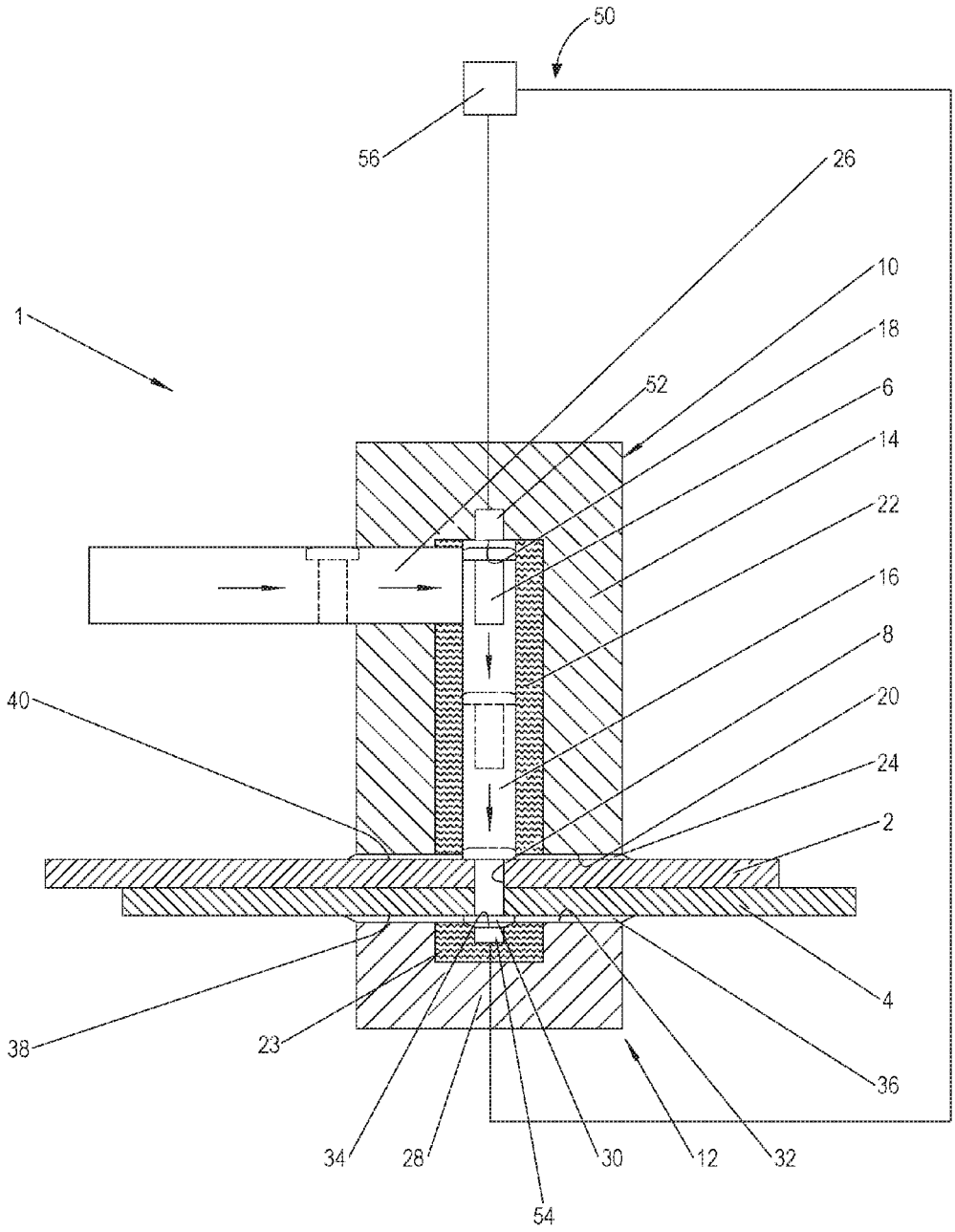
FIG. 3 is a section view of positioning a third exemplary embodiment of a riveting device according to the invention on two components in the overlap joint.

As shown in FIG. 3, for purposes of aligning the shot passage 16 and/or the deforming section to the respective rivet hole 8 the riveting device 1 furthermore has an adjustment system 50. The adjustment system 50 has an electromagnetic radiation source 52, for example a laser diode, a corresponding receiver 54 and an evaluation unit 56 for evaluating a received laser beam fraction. If the riveting device 1 is robot-controlled, the evaluation unit communicates with the aforesaid so that it then carries out corresponding position corrections.

Below, a preferred riveting method of the invention is explained in more detail. In this arrangement the upper tool 10 and the lower tool 12 are both robot-controlled. The components 2, 4 are arranged in an overlap joint and comprise a multitude of rivet holes 8.

In a first step the riveting device 1 is positioned relative to the rivet hole 8. In this process the lower tool 12 is arranged in the overlap joint as a dolly on a lower component side 38, according to the illustration in FIG. 1, of the component 4, and the upper tool 10 is arranged on an opposite, upper, component side 40, according to the illustration in FIG. 1, of the component 2. The deforming section 34 and in particular the shot passage 16 are oriented so as to be aligned with the rivet hole 8 by means of the adjustment system that communicates with the robot control system.

In a second step, from the magazine a rivet 6 is placed in the shot passage 16 by means of the feed device 26.

As soon as the rivet has entered the shot passage 16, in a third step the rivet 6 is immediately electromagnetically accelerated in the direction of the rivet hole 8 or of the components 2, 4. Insertion of the rivet 6 in the shot passage 16 and its acceleration take place quasi-simultaneously. In this process the actuator is controlled in such a manner that the coil 22 establishes an electromagnetic field that shoots the rivet 6 into the rivet hole 8. An electromagnetic acceleration force acts on the rivet 6, by means of which acceleration force said rivet 6 is driven in a single shot into the rivet hole 8. The end of a rivet shaft 30, which end passes through the rivet hole 8, impacts the deforming section 34 where it is plastically deformed.

After placement of the rivet 6, in a fourth step the riveting device 1 is removed from the rivet hole 8, and steps 1 to 3 are repeated on a subsequent rivet hole until all the rivet holes 8 comprise a rivet 6.

In an alternative method according to the invention, in which method the lower tool 12 comprises a multitude of deforming sections 34 and thus covers a rivet hole field comprising a multitude of rivet holes 8, the lower tool 12 is repositioned anew only if all the rivet holes 8 of the rivet hole field comprise rivets 6. However, after placement of each individual rivet 6, the upper tool 10 is positioned anew on the subsequent rivet hole 8, or is aligned anew with the next rivet hole 6 by means of the adjustment system.

If the lower tool 12 also comprises at least one coil 23 (FIG. 3) of the actuator, said coil is controlled in such a manner that the rivet is also subjected to an electromagnetic acceleration force on the side of the lower tool, or in such a manner that the acceleration force extends through the components 2, 4. For optimum acceleration of the rivet 6 the at least one coil 22 on the side of the upper tool communicates with the at least one coil on the side of the lower tool.

If the riveting device 1 comprises a noise cancelling device for the purposes of further noise reduction, when a riveting noise is detected an anti-noise is generated by means of which the riveting noise is additionally reduced.

Figure 2:
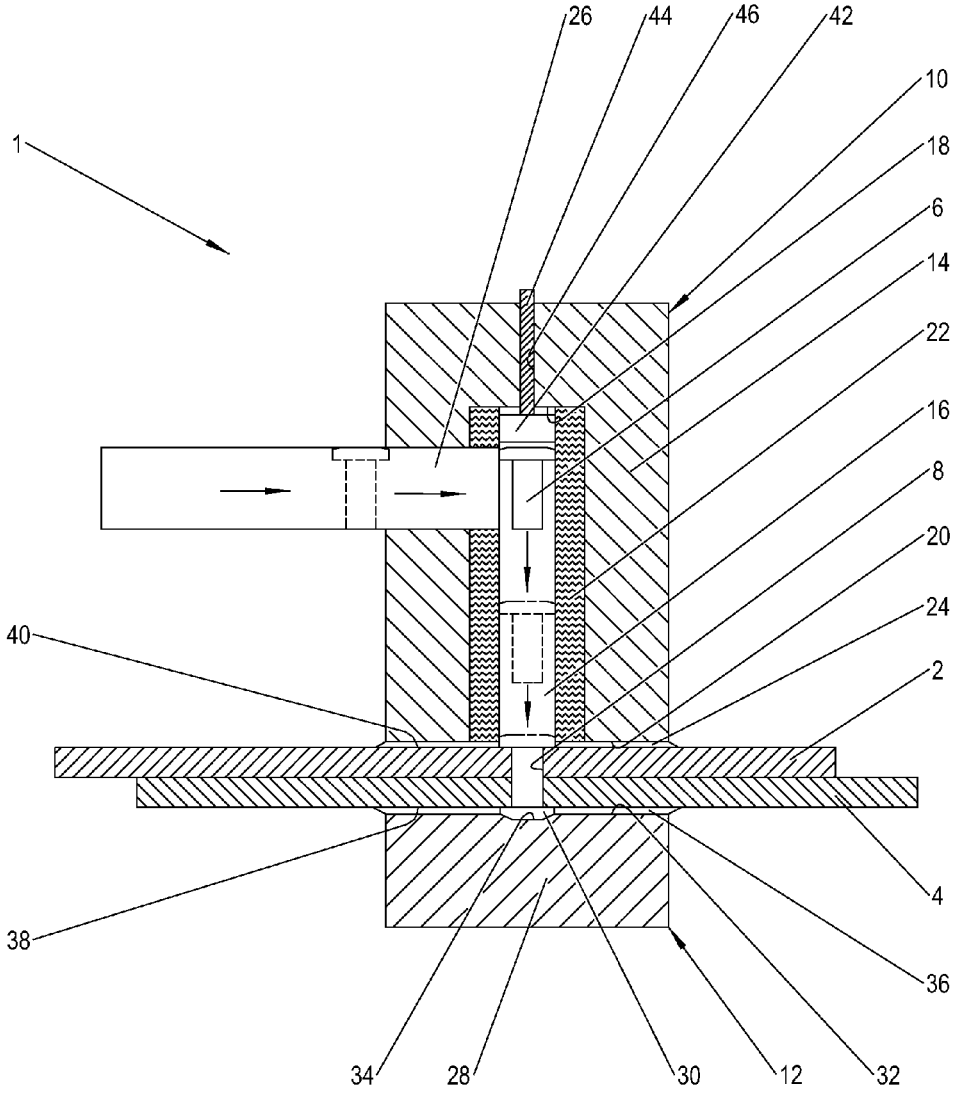
FIG. 2 is a section view of positioning a second exemplary embodiment of a riveting device according to the invention on two components in the overlap joint.

FIG. 2 shows a second exemplary embodiment of the riveting device according to the invention. Complementary to the first exemplary embodiment according to FIG. 1, the exemplary embodiment shown in FIG. 2 has an electromagnetically movable hammer element 42. The hammer element 42 preferably comprises a metal or a metal alloy with a high iron content, and during activation of the actuator acts on the rivet 6. For purposes of guiding the hammer element 42 the aforesaid can comprise a rear guide rod 44 that is held in a guide hole 46 that passes through the ground 18 of the shot passage 16. In the home position the hammer element 42 is positioned on the ground 18 of the shot passage 16. In order to make possible a pulse-like deformation of the end of a rivet shaft 30 the actuator can be controlled in such a manner that the hammer element 38 can electromagnetically be moved forward and backward.

In contrast to the above-mentioned methods, during activation of the actuator and after feeding-in a rivet 6, the hammer element 42 is electromagnetically accelerated in the direction of the rivet hole 8, in this process taking along the rivet 6 located in the shot passage 16. The electromagnetic field generated by the coil 22 primarily acts on the hammer element 42 so that the latter is subjected to the electromagnetic acceleration force or to part of an electromagnetic acceleration force, which part due to the hammer element material is significantly larger than a part of the electromagnetic acceleration force, which part acts on the rivet 6. The rivet 6 is driven into the rivet hole 8 by the hammer element 42, wherein by forward and backward movement of the hammer element 42 the rivet 6 can be deformed in a pulse-like manner.

For the sake of completeness it should be mentioned that the components 2, 4 for purposes of riveting carry out a continuation movement relative to the riveting device 1 over the entire overlap joint and on a lower tool 12 attached to them, in particular, carry out a continuation movement relative to the upper tool 10. The invention includes the case in which the components 2, 4 are stationary, and the riveting device 1 moves onwards to the components 2, 4. However, the invention also includes the case in which the riveting device 1 is stationary, and the components 2, 4 move onwards. Thus, it is imaginable, for example, that in the manufacture of an aircraft fuselage as described above, the aircraft fuselage or its fuselage shells to be riveted (components 2, 4) rotate on a longitudinal axis of the fuselage, while the riveting device 1 is fixed. The riveting device 1 then only carries out a movement to and fro for purposes of positioning the upper tool 10 and/or the lower tool 12; however, no continuation movement, for example rotation, is necessary.

It goes without saying that the invention also includes the case in which both the components 2, 4 and the riveting device 1 carry out, or can carry out, a continuation movement. In this case thus neither the components 2, 4, nor the riveting device 1 are stationary or fixed.

Disclosed is a riveting device for the riveting of components in an overlap joint, with an upper tool for driving a rivet into a rivet hole passing through the components, and with a lower tool as a dolly, which has a deforming section for purposes of plastically deforming the end of a rivet shaft driven through the rivet hole, wherein the riveting device has a magazine with a feed device for purposes of feeding a rivet into a shot passage of the upper tool, an actuator for purposes of accelerating the rivet introduced into the shot passage of the upper tool in the direction of the components, and an adjustment system for purposes of aligning the shot channel with the rivet hole; also disclosed is a method for the riveting of components in an overlap joint.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCE CHARACTERS

1 Riveting device
2 First component
4 Second component
6 Rivet
8 Rivet hole
10 Upper tool
12 Lower tool
14 Housing
16 Shot channel
18 Ground
20 Abutting surface
22 Coil
24 Surface protection device
26 Feed device
28 Housing
30 End of a rivet shaft
32 Supporting surface
34 Deforming section
36 Surface protection device
38 Bottom of component
40 Top of component
42 Hammer element
44 Guide rod
46 Guide hole

The invention claimed is:

1. A riveting device for the connection of components in an overlap joint, comprising:

an upper tool for driving a rivet into a rivet hole passing through the components, and a lower tool as a dolly, which has a deforming section for purposes of plastically deforming the end of a rivet shaft driven through the rivet hole, the riveting device having a magazine with a feed device for purposes of feeding a rivet into a shot passage of the upper tool, an actuator for purposes of accelerating the rivet introduced into the shot passage in the direction of the components, and an adjustment system for purposes of aligning the shot passage with the rivet hole.

2. The riveting device according to claim 1, wherein the actuator is configured to generate an electromagnetic acceleration force acting on the rivet.

3. The riveting device according to claim 1, wherein in the shot passage an electromagnetically movable hammer element is arranged which acts on the rivet.

4. The riveting device according to claim 1, wherein the actuator has at least two coils that communicate with each other, of which one coil is arranged in the lower tool and the other coil is arranged in the upper tool.

5. The riveting device according to claim 1, wherein the adjustment system comprises an electromagnetic radiation source for purposes of optically aligning the riveting device.

6. The riveting device according to claim 1, wherein the lower tool comprises a multitude of deforming sections for covering a multitude of rivet holes.

7. The riveting device according to claim 1, wherein the magazine has a sorting device for providing different types of rivets.

8. The riveting device according to claim 1, wherein at least one of the upper tool and the lower tool, at least in some sections, comprises a housing made of a sound-absorbent material.

9. The riveting device according to claim 1, wherein at least one of the upper tool and the lower tool is associated with at least one noise cancelling device for at least partial superposition of a riveting noise by an anti-noise.

10. A riveting method for the connection of components in an overlap joint with a riveting device by means of which a rivet is driven into a rivet hole passing through the components, the riveting device comprising:

an upper tool for driving a rivet into a rivet hole passing through the components, and a lower tool as a dolly, which has a deforming section for purposes of plastically deforming the end of a rivet shaft driven through the rivet hole, the riveting device having a magazine with a feed device for purposes of feeding a rivet into a shot passage of the upper tool, an actuator for purposes of accelerating the rivet introduced into the shot passage in the direction of the components, and an adjustment system for purposes of aligning the shot passage with the rivet hole, the riveting method comprising the steps:

positioning the riveting device relative to the rivet hole, wherein a lower tool of the riveting device is arranged as a dolly on one face of a component, and an upper tool of the riveting device for driving a rivet into the rivet hole is arranged on the opposite face of another component, and a shot passage in the upper tool is oriented so as to be aligned with the rivet hole, feeding a rivet into the shot passage, and accelerating the rivet in the direction of the components, wherein during driving a rivet in, an end of a rivet shaft driven through the rivet hole is plastically deformed when the end of the rivet shaft impacts a deforming section of the lower tool.

11. The riveting method according to claim 10, wherein the rivet is electromagnetically accelerated.

12. The riveting method according to claim 11, wherein an electromagnetic acceleration force applied on a side of the upper tool and on a side of the lower tool acts on the rivet.

13. The riveting method according to claim 10, wherein an electromagnetically accelerated hammer element acts on the rivet.

14. The riveting method according to claim 10, wherein the lower tool is associated with a rivet hole field.

15. The riveting method according to claim 10, wherein at least partial overlay of a riveting noise with an anti-noise takes place.

* * * * *